United States Patent [19]

Kipfelsberger

[11] Patent Number: 4,887,499

[45] Date of Patent: Dec. 19, 1989

[54] POWER SCREWDRIVER WITH TORQUE LIMITER

[76] Inventor: Albert Kipfelsberger, Welfenstrasse 7, D-8070 Ingolstadt, Fed. Rep. of Germany

[21] Appl. No.: 250,836

[22] Filed: Sep. 28, 1988

[51] Int. Cl.[4] ..... B25B 23/51

[52] U.S. Cl. ..... 81/470; 173/12

[58] Field of Search ..... 81/469, 470; 173/12

[56] References Cited

U.S. PATENT DOCUMENTS

| | | | |
|---|---|---|---|
| 3,939,920 | 2/1976 | Hardiman et al. | 173/1 |
| 4,023,627 | 5/1977 | Clapp et al. | 173/12 |
| 4,081,037 | 3/1978 | Johnson | 173/1 |
| 4,552,041 | 11/1985 | Coyle, Sr. | 81/470 |
| 4,631,992 | 12/1986 | Eckman | 81/470 |

FOREIGN PATENT DOCUMENTS

| | | | |
|---|---|---|---|
| 2236697 | 2/1974 | Fed. Rep. of Germany | 81/470 |
| 2600940 | 7/1977 | Fed. Rep. of Germany | 81/470 |
| 1480894 | 7/1977 | United Kingdom | 81/470 |

*Primary Examiner*—James G. Smith
*Attorney, Agent, or Firm*—Cort Flint

[57] ABSTRACT

The instant invention relates to a power screwdriver with torque limiter, with a drive unit and a secondary transmission, with an output shaft for the attachment of a keyed bit. According to the invention the drive unit is a pneumatic motor (2) with a compressed-air intake (13) and a compressed-air outlet (14), whereby the differential pressure between the compressed-air intake (13) and the compressed-air outlet (14) (measuring circuits 19 and 20) is taken as the measure of the torque produced by the power screwdriver (1). The differential pressure is measured in a differential pressure measuring device (21) and the measure signal is transmitted to a control unit (23). The control unit (23) contains a comparator unit which compares the measured differential pressure signal with a set value of differential pressure (adjusting potentiometer 24) and transmits a switching signal to a switch unit (solenoid valve 19) to switch off the power screwdriver when the compared values become equal. In this manner a simple calculation of torque is achieved by means of a differential pressure measurement in combination with a simple switch-off possibility. In further embodiments the rotational speed of the pneumatic motor is used additionally in the determination of torque.

15 Claims, 3 Drawing Sheets

POWER SCREWDRIVER WITH TORQUE LIMITER

Figure 1:
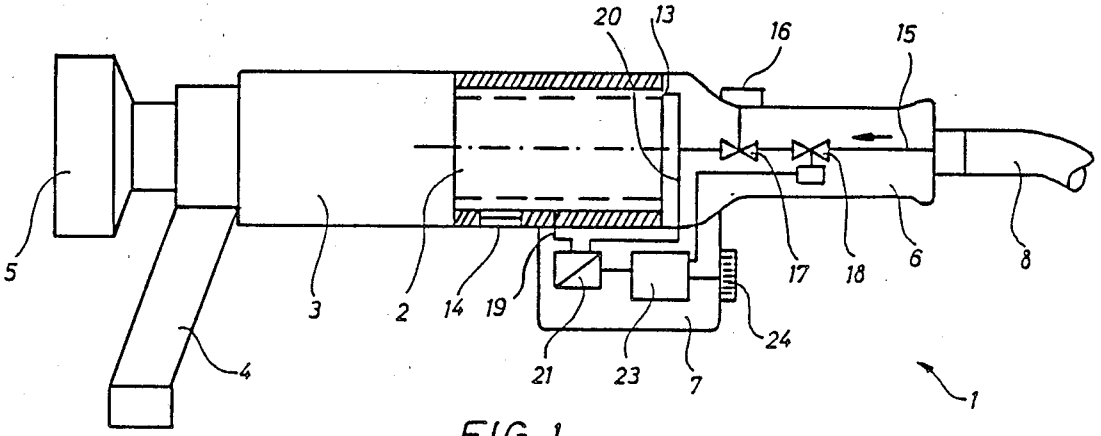

The instant invention relates to a power screwdriver with torque limiter in accordance with the introductory clause of claim 1.

Screw connections, in particular heavy screw connections, must often be tightened at a prescribed torque. A number of devices, so-called power screwdrivers, are known for this.

To evaluate torque, a known power screwdriver (EP-OS No. 0 042 558) uses a separate, variable-geometry module which surrounds the output shaft of the power screwdriver coaxially. This torsion-elastic connecting piece is twisted during the screwing process with increasing screwing torque and activates an elastic switch when a given deformation amplitude has been reached. The drive unit is then shut off by means of this switch. As might be expected, a mechanical switch-off system is not very exact with torsion possibilities which are minimal in this case, so that the determination of torque is not very precise. Furthermore, an additional module is required when increases the weight as well as the cost of the power screwdriver. This also applies to the other embodiment mentioned in the same publication, in which extensometer strips are applied to the torsion-elastic connecting piece, involving the well-known expenses and problems encountered with extensometer strip measuring.

In view of the above it is the object of the invention to improve a power screwdriver of that type with torque limiter and pneumatic motor drive so that the disadvantages of the existing art do not occur.

This object is attained through the characteristics of claim 1.

According to claim 1 a pneumatic motor with compressed-air intake and compressed-air outlet is used as the drive unit. It has been found that the difference in pressure between the compressed-air input and the compressed-air output can be used to advantage as a measure of the torque produced by the power screwdriver. It is not the increase in pressure in the pneumatic system or of the compressed-air arrival during torque increase but the differential pressure applied to the pneumatic motor which is used to determine torque. In this way marginal influences which could influence the calculation of torque, such as varying operating temperatures, varying or oscillating pressures in the air supply, etc., can be mostly eliminated so that a simple and relatively precise determination of torque through pressure difference is possible.

To measure differential pressure the known differential pressure measuring devices such as membrane boxes, piezoelectric sensors, inductive sensors, etc. can be used.

Such a differential pressure measuring device is combined with a comparator unit in which a desired differential pressure value is set and which is provided with a control output which switches to a set value of differential pressure as the measured difference in pressure increases. This control output is connected to a switch unit which shuts off the power screwdriver when the set value of differential value is reached.

The definite torque values attributed to differential pressure values are found for a given power screwdriver model through tests and an appropriate characteristic curve is entered into the comparator unit. Basically, higher differential pressure values correspond to higher torque values.

The operation of such a power screwdriver is thus very simple, since the power screwdriver runs when it has been switched on until the predetermined set value of torque has been reached in accordance with a set value of differential pressure, and then shuts itself off automatically.

To measure the differential pressure it is indicated, according to claim 2, to provide air circuits going from the compressed-air supply circuit and the compressed-air outlet circuit to the differential pressure measuring device. The most suitable branch-off point for the measuring circuit depends upon the type and the geometry of the pneumatic motor involved and could for example be located in the same operating space as the motor. The most suitable branch-off points for the measuring circuits must be determined through experimentation.

In order for the power screwdriver to switch off automatically at different set value of torques, claim 3 proposes that the applicable set value of differential pressure be adjusted manually, whereby the scale of settings is calibrated in torque values.

A particularly advantageous embodiment is created by electric-resistance processing of the differential pressure value in a differential pressure measuring transducer which converts the differential pressure signal into an electric signal according to claim 4. However, a mechanical design is also possible, in which the differential pressure measuring device is connected to a down-stream mechanical comparator and switch unit.

A simple and light-weight unit is produced according to claim 5 however, if the comparator unit carries out an electric comparison and if the desired value can be set in form of an electric signal by a potentiometer.

The interrelation between the measured differential pressure and the torque produced by the power screwdriver depends upon the construction and geometry of the pneumatic motor and, in general, will not be linear. Such non-linearity can be taken into account for example through a corresponding non-linear scale on the set-point adjuster. According to claim 6 however, it is advantageous to provide the set-point adjuster with a linear scale and to even out non-linearities by means of a linearization unit. The linearization unit could for example be installed in the electric measuring transducer or in the electric comparator in form of an electric unit, or in case of a mechanical design, could for example by realized by means of a cam disk.

To switch off the power screwdriver upon reaching the set value of torque, claim 7 provides for the utilization of a switching value which switches off the compressed-air supply. With an electric comparator unit a solenoid valve is preferably used for this, and with a mechanical model a mechanically controlled valve operating in the same manner is used.

For manual switching (on and off) a conventional, known, manually controlled switching valve is in any case provided in the compressed-air supply circuit. To switch off automatically, either a second valve can be provided or this manual switching valve can also be used. In this case a known electric or mechanical priority circuit is to be provided for this valve for automatic switch-off instead of manual switching.

Claim 8 proposes the installation of a solenoid valve with bistable states for open and closed position that are triggered electrically by switching impulses. In this way only small ammounts of energy need be expended to switch the solenoid valve. The accumulator which is required for this can be of small size so that it can fit into the housing of the machine even if long operations are to be carried out. It is furthermore also possible to use the power screwdriver in explosion-protected areas thanks to the small accumulator, since the latter could be cast together with the machine electronics. An especially preferred embodiment is mentioned in claim 9 and is obtained through the fact that in order to determine the torque produced by the power screwdriver the rotational speed of the pneumatic motor is taken into account in addition to the measured differential pressure. This yields an additional influencing factor which increases the precision of shut-off. Indeed, the direct influence of the rotational speed may vary depending on the pneumatic motor used and on the geometric data. To take the rotational speed into account, the rotational speed signal and the differential pressure signal are transmitted to the switch unit. Empirically and experimentally determined characteristic and reference parameters, e.g. performance and reference characteristics are stored in appropriate memories, and through them the occurring torque is calculated and compared with the set value of torque upon receipt of a certain rotational speed signal and differential pressure signal.

In a simpler embodiment it suffices to transmit the differential pressure signal and the rotational speed signal to a combinatorial circuit and to utilize this combined signal in the switch unit for a comparison between set value and actual value or for classification under stored performance characteristics.

It has been found that in actual models a precise determination of the torque is obtained according to claim 10 if the product of the differential pressure signal multiplied by the period and in some cases by an additional constant is utilized as a signal that changes with the load in order to effect switch-off. The arrangement becomes especially compact, simple as well as economical through the fact that, according to claim 11, the already required differential pressure sensor is also used to determine the rotational speed. The differential pressure signal amplitude oscillates at the rhythm of the blades of the pneumatic motor moving past the intake openings. The frequency of the differential pressure signal divided by the number of blades thus becomes is a measure of the rotational speed of the pneumatic motor or of its period. A rotational speed signal can be obtained easily in a conventional manner whereby impulses which are counted in a counter with a gating circuit and a clock are produced as the signal goes through a trigger threshold (e.g. at each negative flank).

The invention is explained in greater detail with respect to characteristics and advantages through an embodiment.

Figure 2:
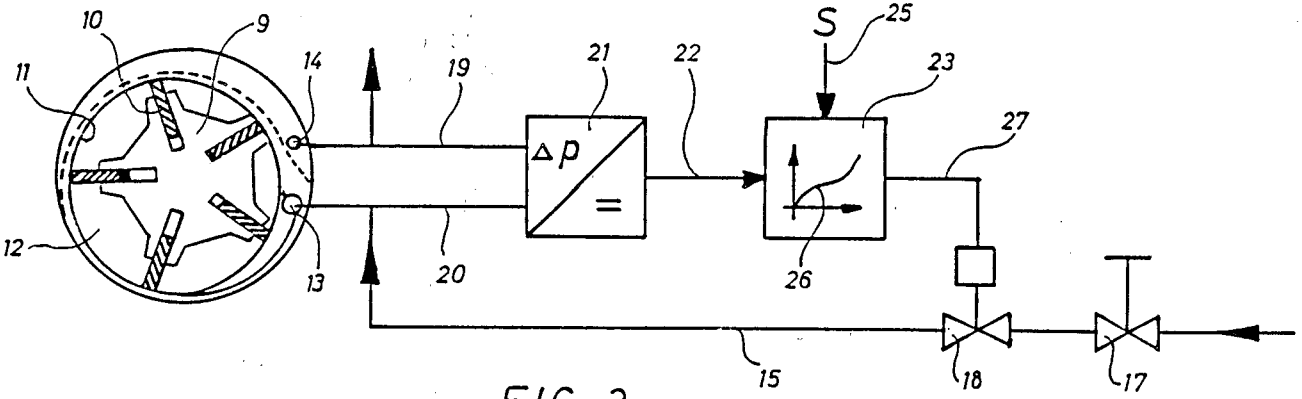
Figure 3:
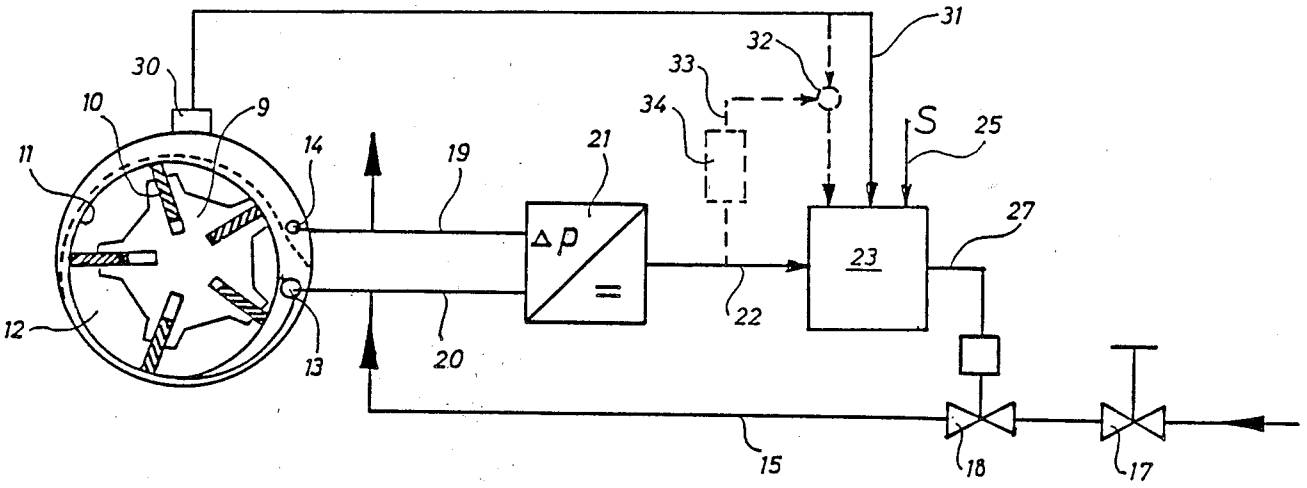
Figure 4:
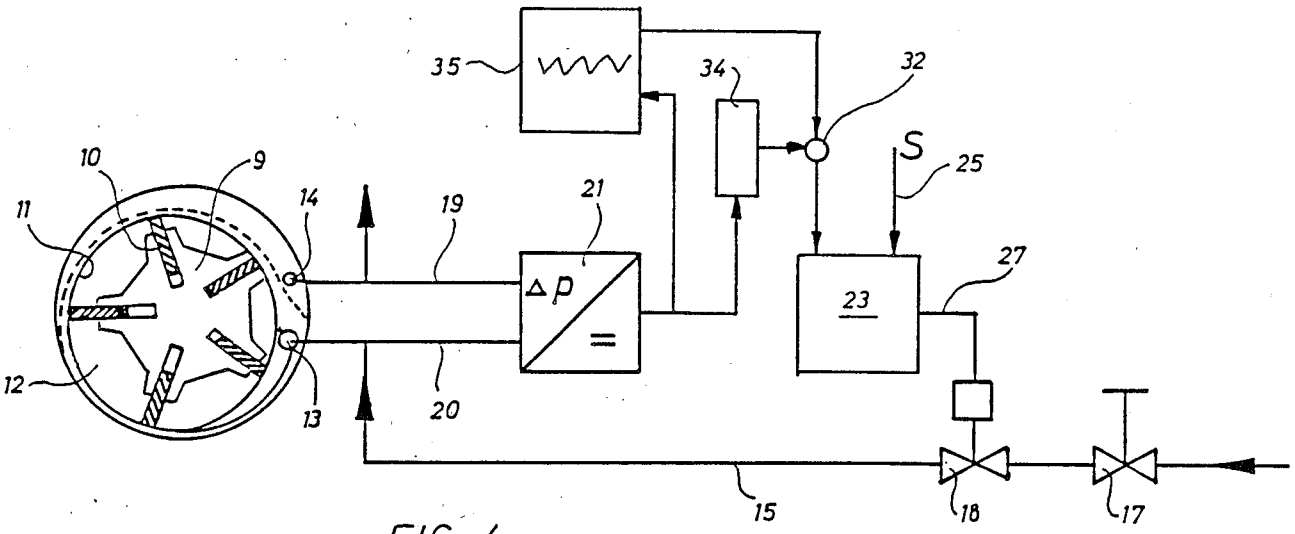
Figure 5:
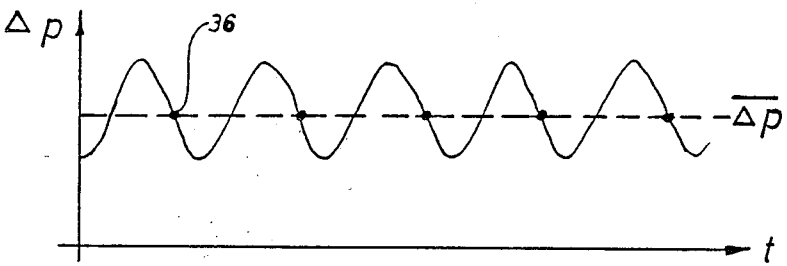

FIG. 1 shows a schematic longitudinal view of a power screwdriver,

FIG. 2 shows a schematic view of a cross-section through a pneumatic motor of the power screwdriver according to FIG. 1, with the elements for torque limitation, FIG. 3 shows a schematic view according to FIG. 2, in which a speed signal for the torque limiter is included additionally, FIG. 4 shows a schematic view according to FIG. 3 in which the rotational speed is found through the differential pressure signal, and FIG. 5 is a schematic representation of the course of amplitude of the differential pressure signal.

FIG. 1 shows a power screwdriver 1 with a pneumatic motor as the drive unit, with a secondary transmission 3, a support leg 4, a screw head 5, a handle 6, a control element 7 and a compressed-air connection 8.

FIG. 2 shows a cross-section through the pneumatic motor 2 in which a rotor 9 with blades 10 capable of being shifted in slits can be recognized, whereby the blades 20 bear upon an eccentrically offset running surface 11. In this manner operating chambers 12 with variable volumes are created which can be subjected to compressed air via a compressed-air admittance opening 13. The compressed air re-emerges at the compressed-air outlet opening 14 after one rotor rotation.

The compressed air is supplied via circuit 15 and via the compressed-air connection 8. A shut-off valve 17 which can be actuated by a manual switch 16 and a solenoid valve 18 in series with it (before or after the shut-off valve 17) by means of which the circuit 15 can also be shut off, is located within said circuit 15.

The pressure difference between the pressure of air input and the pressure of air output is measured by two measuring circuits 19 and 20 branching off at the appropriate locations and by the differential pressure measuring transducer 21.

The differential pressure measuring transducer 21 converts the differential pressure signal into a corresponding electrical direct-current signal which is transmitted through circuit 22 to unit 23. This unit 23 contains a comparator to compare the set value which can be set from the outside (potentiometer 24 in FIG. 1; set value arrow 25 in FIG. 2) with the differential pressure signal (circuit 22). It further contains a linearization unit which is indicated schematically in form of the curve 26. Furthermore it contains a toggle switch which switches when the set value of differential pressure or set value of torque is equal to the measured differential pressure which increases during the screwing process. This switching signal is transmitted via the electric circuit 27 to the magnet of the solenoid valve 18, causing the solenoid valve to be switched into its shut-off position. The power screwdriver 1 shown has the following functions: For screwing (or unscrewing) the power screwdriver 1 is set with its screwing head 5 against the screw connection and the support leg 4 is placed against a solid counter-support.

Between the compressed-air inlet 13 or between the circuits 15, 20 and the compressed-air outlet 14 or circuit 19 there is no differential pressure since the compressed air going to the pneumatic motor 2 is shut off by the hand-operated shut-off valve 17. Therefore the solenoid valve is switched into open position by the measuring transducer and downstream electronics.

When the shut-off valve 17 is opened by means of the manual switch 16, the compressed air reaches the pneumatic motor 2 via circuit 15, causing said pneumatic motor 2 to run at a high rotational speed and to fasten the screw connection via the secondary transmission. The tighter the screw connection is fastened, the greater the counter-force acting upon rotor 9 is the pneumatic motor 2 becomes. The rotor 9 and the blades 10 thereby oppose a growing resistance to the prevailing compressed air so that the difference in pressure between compressed-air input into the motor and compressed-air output from the motor increases and thus becomes a measure of the torque produced by the power screwdriver 1.

Before the beginning of the screwing process the desired fastening torque was set in form of a switch-off value at the potentiometer 24. When the measured difference in pressure or the corresponding electrical signal has reached the set value, the solenoid valve 18 is switched into its shut-off position, for example by a switching impulse. This causes the drive energy in form of air arrival to be interrupted and the pneumatic motor stops without significant after-running so that the power screwdriver 1 is shut off (independently of the position of valve 17). Following automatic switch-off the operator brings the shut-off valve 17 manually into its shut-off position and lifts off the screwdriver.

The shown model with an automatic switch-off of the energy supply is a preferred embodiment of the invention. It can be seen however that other means of shutting the screwdriver off, based on the same principle can be realized, e.g. by switching a coupler in the transmission.

FIG. 3 furthermore shows a rotational speed sensor 30, the rotational speed signal of which is transmitted via circuit 31 in addition to the differential pressure signal (circuit 22) to the unit 23. The torque produced is calculated in unit 23 by finding the values of the differential pressure and the rotational speed by means of the characteristic parameters or characteristic stored in it and is then compared with the set value of torque 25.

In the embodiment indicated by broken lines the rotational speed signal is transmitted not directly to unit 23 but to an intermediary circuit 32, as is the case for the differential pressure signal (circuit 33). The intermediate signal evaluated in the intermediate switch 32 is then transmitted to unit 23 for comparison. Since the amplitude of the differential pressure signal oscillates (see FIG. 5) it is best to transmit this signal via a smoothing unit 34 and to thus obtain a median differential pressure.

In FIG. 4 the rotational speed is calculated directly through the amplitude oscillations of the differential pressure signal instead of using a conventional, inductive, capacitive rotational speed sensor or through one using light impulses. The course of amplitudes of the differential pressure signal is indicated schematically in FIG. 5. The differential pressure signal is transmitted to a unit 35 which contains essentially a trigger circuit, a gating circuit with clock and a counter. At each passage of the negative flank of the differential pressure signal (points 36) an impulse is produced which is counted in a clock-controlled counter, whereby the counted value is a measure of the rotational speed of the pneumatic motor. In the embodiment shown here the rotational speed value and a mean differential pressure value are transmitted to the intermediary circuit 32 which multiplies these values and makes available the found product as a variable value for switch-off.

In conclusion, the invention makes it possible to obtain simple, precise and effective torque limitation in a pneumatically operated power screwdriver.

I claim:

1. A power screwdriver having a torque limiter, a drive unit, and a secondary transmission coupled to said driving unit having an output shaft for the attachment of a keyed bit, characterized in that said drive unit includes a pneumatic motor having a compressed-air intake and a compressed-air outlet; a differential pressure measuring unit for measuring the pressure difference between said compressed-air intake and said compressed-air outlet as an indication of the torque produced by the power screwdriver; a comparator unit for comparing said measured pressure difference in the form of an actual pressure value with a preset pressure difference in the form of a set pressure value representing a preset torque value, said comparator unit having a switch output signal; and a switch unit for switching said power screwdriver off when said set value of differential pressure has been reached in response to said switch output signal.

2. The device of claim 1 including air circuits connecting said compressed-air intake to operating spaces of said pneumatic motor, and connecting said compressed-air outlet to said differential pressure measuring unit.

3. The device of claim 1 wherein said comparator unit includes a setting scale calibrated in corresponding assigned torque values for setting said set pressure value.

4. The device of claim 1 wherein said differential pressure measuring unit includes a measuring transducer which converts the measured pressure difference into an electrical signal.

5. The device of claim 4 wherein said comparator unit includes means for electrically comparing said measured pressure values and said set pressure value, and said set pressure value can be preset in form of an electric signal.

6. The device of claim 5 including a linearization unit provided between said differential pressure measuring unit and said switch unit for providing a linearized switching signal.

7. The device of claim 1 wherein said switch unit includes a switching valve in said compressed-air intake circuit.

8. The device of claim 7 wherein said switching valve consists of a solenoid valve connected to the comparator unit.

9. The device of claim 7 wherein said switching valve includes a magnetic valve having an electric, bistable state capable of being triggered by switching impulses to an open position in a first state and to a closed position in a second state.

10. The device of claim 1 including a rotational speed unit for measuring the rotational speed of the pneumatic motor to provide a rotational speed signal which is additionally taken into consideration to determine the torque produced by the power screwdriver, said rotational speed signal and measured pressure difference signal are transmitted to switch unit.

11. The device of claim 10 including a combination circuit for transmitting said rotational speed signal and said measure pressure difference signal.

12. The device of claim 11 wherein said combination circuit multiplies the pressure difference signal by the period for one revolution of the pneumatic motor and generates a switching signal to switch off the power screwdriver.

13. The device of claim 10 wherein said rotation speed unit processes periodic amplitude changes in the differential pressure signal as a function of the rotational speed to determine the rotational speed of the pneumatic motor.

14. The device of claim 13 including impulses produced by said amplitude changes passing through a trigger threshold; a counter having a gating circuit, and a clock for counting said impulses to produce a counted value; and the counted value is measured to determine the rotational speed.

15. The device of claim 1 including a housing of the power screwdriver which contains all of the electrical elements which are cast in said housing as one piece thereby eliminating external control and regulating units so that all influences acting upon the calculation of torque are taken into account within the power screwdriver and the power screwdriver can be used in an explosion-protected area.

* * * * *